US006133882A

United States Patent [19]

LaFleur et al.

[11] Patent Number: 6,133,882

[45] Date of Patent: Oct. 17, 2000

[54] MULTIPLE PARASITIC COUPLING TO AN OUTER ANTENNA PATCH ELEMENT FROM INNER PATCH ELEMENTS

[75] Inventors: Philippe LaFleur, Ottawa; David Roscoe, Dunrobin; James S. Wight, Ottawa, all of Canada

[73] Assignees: Her Majesty the Queen in right of Canada, as represented by the Minister of Industry through Communications Research Centre; Resonance Microwave Systems Inc., both of Ottawa, Canada

[21] Appl. No.: 09/217,903

[22] Filed: Dec. 22, 1998

[30] Foreign Application Priority Data

Dec. 22, 1997 [CA] Canada ..... 2225677

[51] Int. Cl.[7] ..... H01Q 1/38

[52] U.S. Cl. ..... 343/700 MS; 343/846

[58] Field of Search ..... 343/700 MS, 824, 343/833, 834, 837, 844

[56] References Cited

U.S. PATENT DOCUMENTS

| | | | |
|---|---|---|---|
| 4,486,758 | 12/1984 | De Ronde | 343/700 MS |
| 5,497,164 | 3/1996 | Croq | 343/700 MS |
| 5,835,062 | 4/1981 | Heckaman et al. | 343/700 MS |

*Primary Examiner*—Don Wong
*Assistant Examiner*—James Clinger
*Attorney, Agent, or Firm*—Freedman & Associates

[57] ABSTRACT

An antenna array is disclosed wherein radiators are parasitically coupled to each other, forming an efficient feed network. Parasitic coupling of patches is arranged so that some patches are fed by a plurality of other patches which are parasitically coupled thereto. The resulting array is low profile and high gain. By positioning patches on different layers with different dimensions, a broadband design for the antenna array is achieved.

25 Claims, 17 Drawing Sheets

MULTIPLE PARASITIC COUPLING TO AN OUTER ANTENNA PATCH ELEMENT FROM INNER PATCH ELEMENTS

FIELD OF THE INVENTION

This invention relates to high-gain broadband antennas and more particularly to an efficient, low profile patch antenna.

BACKGROUND OF THE INVENTION

It is highly desirable to produce a compact, lightweight, efficient, low-profile, high-gain, broadband antenna for use in wireless communications. Presently, antennas encompassing all of these qualities are not available. Usually, antenna design dictates that a trade off is necessary between size, bandwidth and efficiency. Recognition of the trade off has resulted in several prior art design approaches for antennas.

A reflector antenna, commonly a parabolic reflector, uses a horn radiator to illuminate its aperture. The shape of the reflector causes it to redirect energy fed to it by the horn in a high gain directional beam. Unfortunately, a horn-fed reflector is inefficient and bulky. Illumination of the reflector always results in either overspill or under utilisation of available aperture to avoid overspill. Typical efficiencies that can be achieved by a reflector antenna are 60%. Large overall size results from a boom supporting the horn and the reflector.

Another approach to antenna design uses an array of microstrip patches or another form of printed radiator. Such antennas are low-profile, as the depth is only a thickness of an antenna substrate. Arrays of microstrip patches group many low gain elements together, each fed so as to contribute to formation of a high gain beam. Power is distributed to each of the elements via a feed network, which is the antenna's primary source of inefficiency. It is well known that large feed networks with corresponding large line losses, significantly reduce antenna efficiency.

The above-described arrays are low-profile but suffer in efficiency due to the heavy losses in the feed network. This increases the required array size for a given gain requirement, but the nature of these feed networks is that feed losses become more significant as array size increases. This makes achieving efficient large arrays very difficult. Furthermore, the bandwidth of the above-described arrays is limited by the bandwidth of the elements employed; if a narrowband element such as a simple microstrip patch is used, the array bandwidth is no broader than the bandwidth of each element.

Another approach currently employed is similar to the above-described array, but stacked microstrip patches having dielectric layers therebetween are used instead of simple microstrip patches. The stacked microstrip patches alleviate bandwidth limitations inherent in the previously described array antenna by providing a broad bandwidth element. Stacked patches are well known in the art and comprise two or more patches stacked on top of each other. Each successively higher patch is smaller than those below and centred over the patch immediately below it. Each smaller patch uses the one beneath it as its ground plane, and radiates around the patch above. This technique broadens bandwidth, but does not increase gain, as the patches all have similar radiation characteristics. Bandwidths achieved using this technique can reach 40%.

Arrays of quad-patch elements differ from the previously described arrays in that an array element comprises a quad-patch element in the form of a sub-array fed by a single patch element below each of the patch elements in the sub-array. The quad patch element consists of a first patch which then parasitically couples to four patches disposed above the first patch. A single corner and/or edge of the first patch drives or feeds each patch of the four patches. This reduces feed network complexity and feed network losses, because each group of four radiating patches is fed by a single feed network line.

The use of the quad-patch element provides broad bandwidth, though to a lesser extent than, for example, a stacked patch. A bandwidth of around 15% is achievable. The feed loss problem is significantly reduced due to the larger size and associated higher gain of the quad patch element. The four patches are fed by directly coupling to the first patch—the first patch couples parasitically to the upper four patches. Unfortunately, this configuration is a compromise providing too little bandwidth and insufficient efficiency when placed in large arrays. Also, it is incapable of significant expansion because the feeding technique—one-corner and/or edge-feeds-one-patch—is limiting.

Another issue in antenna design is isolation. It is desirable to provide an antenna capable of radiating two signals that are isolated one from the other. Unfortunately, using conventional patch antenna designs as described above, isolation is insufficient for many applications.

OBJECT OF THE INVENTION

In an attempt to overcome these and other limitations of the prior art, it is an object of the invention to provide a low-profile, high-gain, broadband array antenna.

SUMMARY OF THE INVENTION

In accordance with the invention, there is provided an array antenna comprising:

a first radiator for coupling to a feed;

a first array of radiators disposed so that each radiator within the first array of radiators is in close proximity to the first radiator and spaced therefrom for parasitically coupling to the first radiator;

a second array of radiators disposed so that each radiator within the second array of radiators is in close proximity to a radiator in the first array of radiators and is spaced therefrom for parasitically coupling to a radiator from the first array of radiators and wherein some of the radiators in the second array of radiators is in close proximity to a plurality of radiators from the first array of radiators for parasitically coupling to the plurality of radiators from the first array of radiators.

BRIEF DESCRIPTION OF THE DRAWINGS

An exemplary embodiment of the invention will now be discussed in conjunction with the attached drawings in which.

DETAILED DESCRIPTION OF THE INVENTION

In the specification and claims that follow, the following terms are used to mean the following definitions:

f is free space frequency of an electromagnetic wave;

g is gain of an antenna relative to an isotropic radiator;

az is an azimuth;

el is elevation;

deg is degrees as is °;

dB is decibels;

dBi is decibels relative to an isotropic radiator;

$\epsilon_r$ is the permitivity of a substance such as a dielectric substance; and GHz is Giga Hertz where 1 GHz is 1,000,000,000 cycles per second.

Figure 1A:
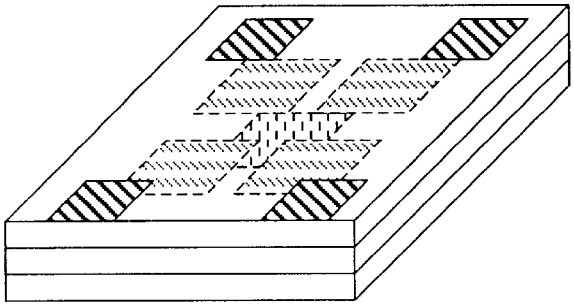
FIG. 1 is a plurality of simplified views of an array antenna designed by extension of quad-patch radiator designs.
Figure 1B:
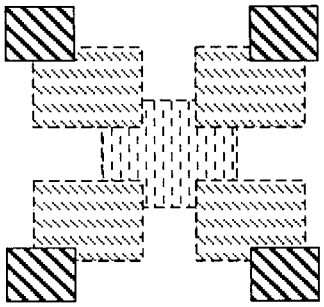
Figure 2A:
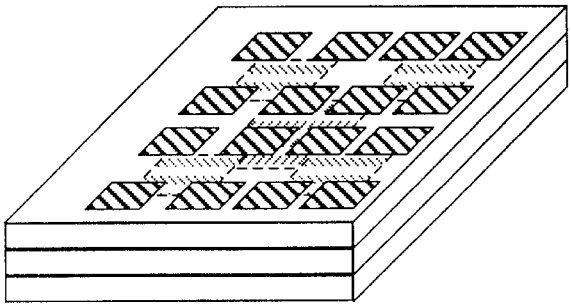
FIG. 2 is a plurality of simplified views of a multi-layer array of patches to form a patch antenna array designed by extension of the quad-patch antenna radiator designs.
Figure 2B:
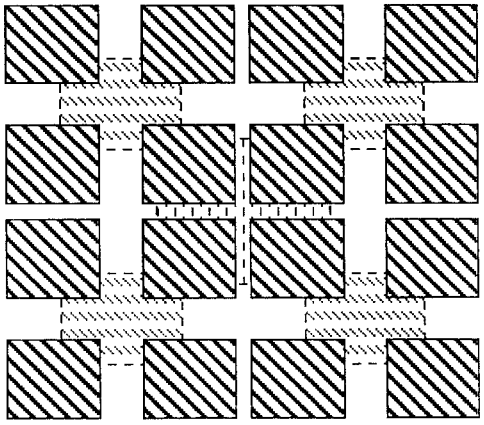

Referring to FIGS. 1 and 2, a brief description of obvious extensions to the quad-patch antenna of the prior art is presented. The quad-patch antenna uses one patch corner and/or edge to feed one patch. The logical extension to this is to continue using the same one corner and/or edge feeds one patch methodology, configurations of which are shown in FIGS. 1 and 2. Neither of these configurations provides desired performance. In essence, these obvious extensions are substantially unworkable for one reason or another. Patch overlap and array irregularities or patch spacing are of significant concern and gain and bandwidth requirements as desired are not achieved in an obvious fashion. The antenna array of FIG. 2 is also obviously limited in terms of gain, size and application.

As used herein, the term V-configuration antenna refers to a plurality of radiating elements disposed in a triangular and/or pyramidal shape with an apex thereof receiving a signal from a feed and, through parasitic coupling, providing the fed signal to other patches within the antenna. Typically, signals are parasitically coupled in a direction from the apex to the base of the structure. The term parasitically coupled refers to parasitic coupling between a first element and a second element when the elements are adjacent and when the elements separated by other elements wherein energy is parasitically coupled form the first element to any number of elements in series and then parasitically coupled to the second element. The term directly parasitically coupled is used to refer to parasitic coupling between two adjacent elements.

Figure 3A:
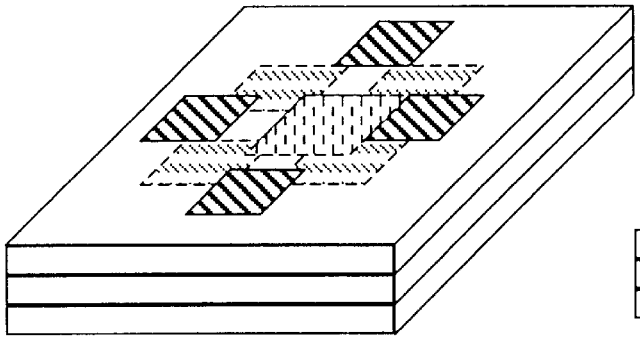
FIG. 3 is a plurality of simplified views of an array antenna according to the invention in a "V" configuration.
Figure 3B:
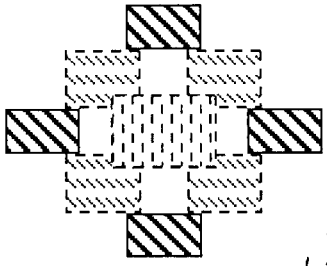
Figure 3C:
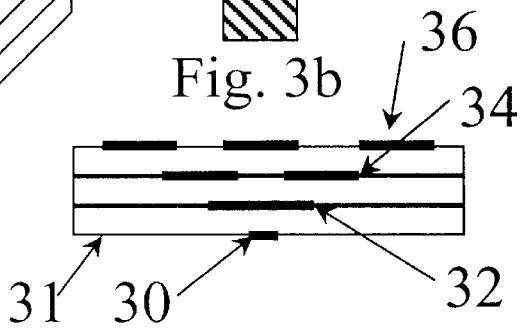

Referring to FIG. 3, a multi-layer array in a V-configuration is provided wherein each patch, other than those directly coupled to the feed or the feed network, is coupled parasitically. Multiple parasitic coupling to an outer antenna patch element from an inner patch element results in increased efficiency by eliminating all or a large portion of the feed network. In general, the principle appears similar to the quad-patch radiator described above; however, according to the invention some patches are parasitically coupled to receive energy from more than one patch thereby overcoming limitations in the embodiments of FIGS. 1 and 2. As described below, the advantages to a configuration wherein a radiator is fed by a plurality of radiators are significant.

In the embodiment of FIG. 3, a single feed 30 is used to feed a first patch 32. The first patch 32 is parasitically coupled to four patches 34, one patch of the four patches 34 fed by one corner of the first patch 32. Those four patches 34 are parasitically coupled to 5 further patches 36. Each of these further patches 36 is fed by a corner and/or edge of more than one patch of the four patches 34. The total size of the array is dependent upon the number of layers and the number of patches in each layer. Also, the number of patches fed by a feed or feeds is significant. In FIG. 3, three layers and one first patch 32, the fed patch, result in an outer layer having 5 radiating patches 36. This multi-layer structure is mounted on a single ground plane 31.

According to the present embodiment, on each successive layer, the patches are designed with reduced size as shown in FIG. 3. Thus the dimensions of 32 are greater than the dimensions of 34 which in turn are greater than the dimensions of 36. This provides increased bandwidth. Unfortunately, due to phase related issues, a V-configuration antenna is limited to a gain of about 15 dB unless phase related considerations are accounted for during design and manufacture. For example, when spacing and dielectric material between layers and radiating elements is chosen to ensure appropriate phase at each radiating element in the outer layer or, more preferably in each layer, gain can be increased significantly by increasing the number of layers in the antenna array. This is discussed further with reference to FIG. 10.

Design of an antenna array having a V-configuration is possible for horizontally polarised operation, vertically polarised operation or operation with both horizontal and vertical polarisation. This depends greatly on design criteria and desired operating modes.

As used herein, the term VVV-configuration antenna refers to a plurality of radiating elements disposed on two or more planes. A patch for receiving a signal from a feed and, through parasitic coupling, providing the fed signal to other patches within the antenna. Typically, signals are parasitically coupled from the fed patch outward in a zig-zag fashion between the planes in which the antenna is disposed.

Figure 4A:
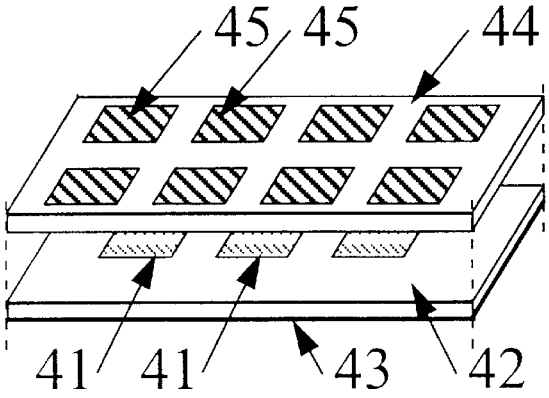
FIG. 4 is a plurality of simplified views of an array antenna according to the invention in a "VVV" configuration.
Figure 4B:
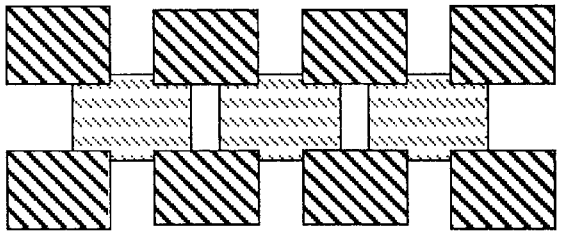

Referring to FIGS. 4*a* and 4*b*, an embodiment of the invention is shown wherein a "VVV-configuration" is used for the antenna array. In this configuration, three layers are used for constructing the array antenna. Patches 41 on the centre layer 42 of the three layers are parasitically coupled to patches on the top layer 44. Each patch on the centre layer 42 other than the fed patch is fed from a patch 45 on the outer layer (shown as the top layer 44 in FIG. 4*a*) and feeds another patch 45 on the outer layer 44. Of course, the fed patch may also be fed by patches 45. The bottom layer 43 is the ground plane. A signal is fed to the fed patch using a feed in the form of a slot in the ground plane 43. Of course, other feed structures are also useful with the present invention. The result is an easily manufactured patch antenna having high gain, broad bandwidth, and high efficiency. Optionally, a fed patch on a fourth layer disposed above the ground plane 43 is used to feed some patches 41 on the centre layer 42.

As in FIG. 3, patch sizes may vary between layers. In design of an antenna having a VVV-configuration, phase is easily maintained through accurate patch spacing. Essentially, when patch spacing is an integer multiple of 360°, phase of a radiated signal from each patch is the same. This is analogous to design and implementation of a series feed network which is well known in the art.

Generally, the VVV-configuration has a narrower available bandwidth than the V-configuration because the desired phase distribution is maintained over a narrower bandwidth.

Design of an antenna array having a VVV-configuration is possible for horzontal polarisation, vertical polarisation or both. This depends greatly on design criteria and desired operating modes. Design criteria are well known in the art.

A multi-layer antenna configuration, based upon multiple parasitic coupling from inner patch elements to an outer antenna patch element, provides broadband performance due to the multiple resonances of the structure. This is achieved, for example, by sizing patches on different layers differently in order to achieve the multiple resonances. High gain with high efficiency is obtained because a large aperture is fed without the use of transmission line feed networks. The embodiments shown in FIGS. 3 and 4 are both printed antennas and, therefore, are low-profile and lightweight.

Figure 5A:
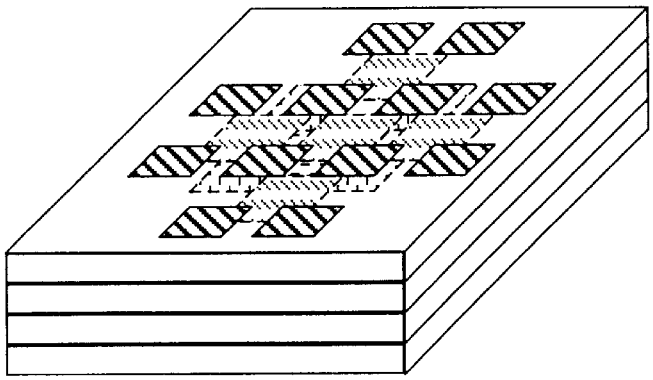
FIG. 5 is a plurality of simplified views of an array antenna according to the invention in the "V" configuration and having 10 patches arranged in 4 layers.
Figure 5B:
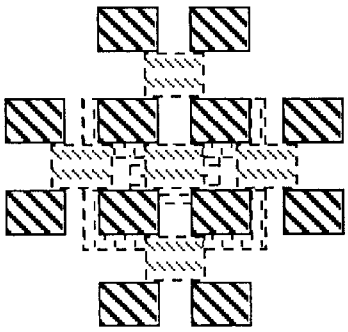
Figure 5C:
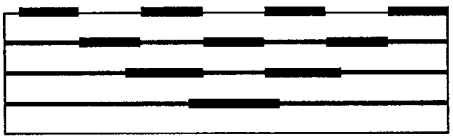

Referring to FIG. 5, a simplified diagram of an array antenna according to the invention is shown. Multiple parasitic coupling to an outer antenna patch element from inner patch elements is used. Some patch elements are parasitically coupled to 4, 3, 2, or 1 other patch elements from another layer. Of course, 5 or more patch elements may parasitically couple to a single patch element in some applications. In other words, two or more patch element corners and/or edges are used to feed another patch element through parasitic coupling therebetween. Prior art low-profile high gain broadband antennas having multiple parasitic couplings in configurations as described herein, are unknown to the inventors.

Figure 6:
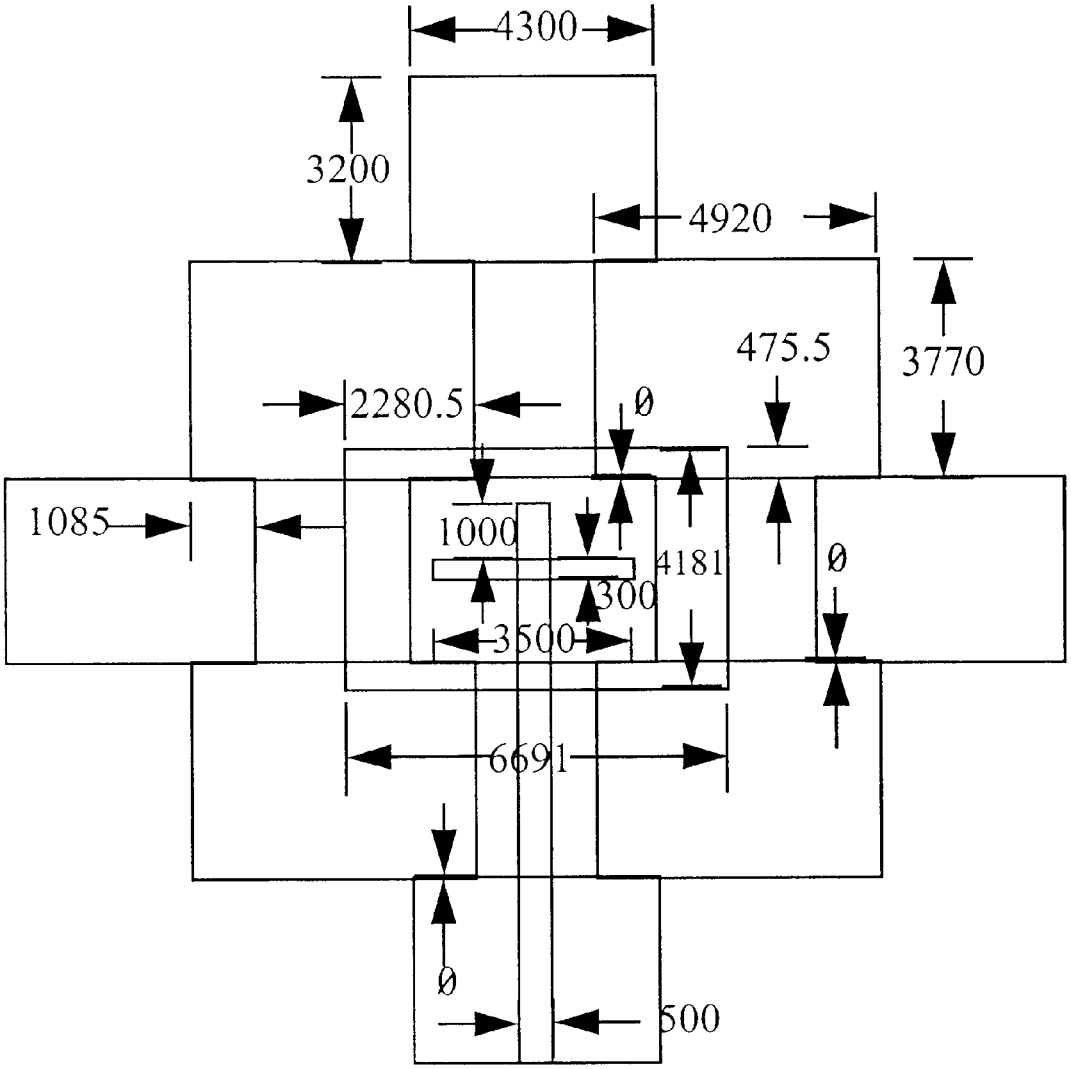
FIG. 6 is a simplified schematic view of a microstrip patch array antenna in a "V" configuration according to the invention comprising 5 patches on the outer most layer.
Figure 7:
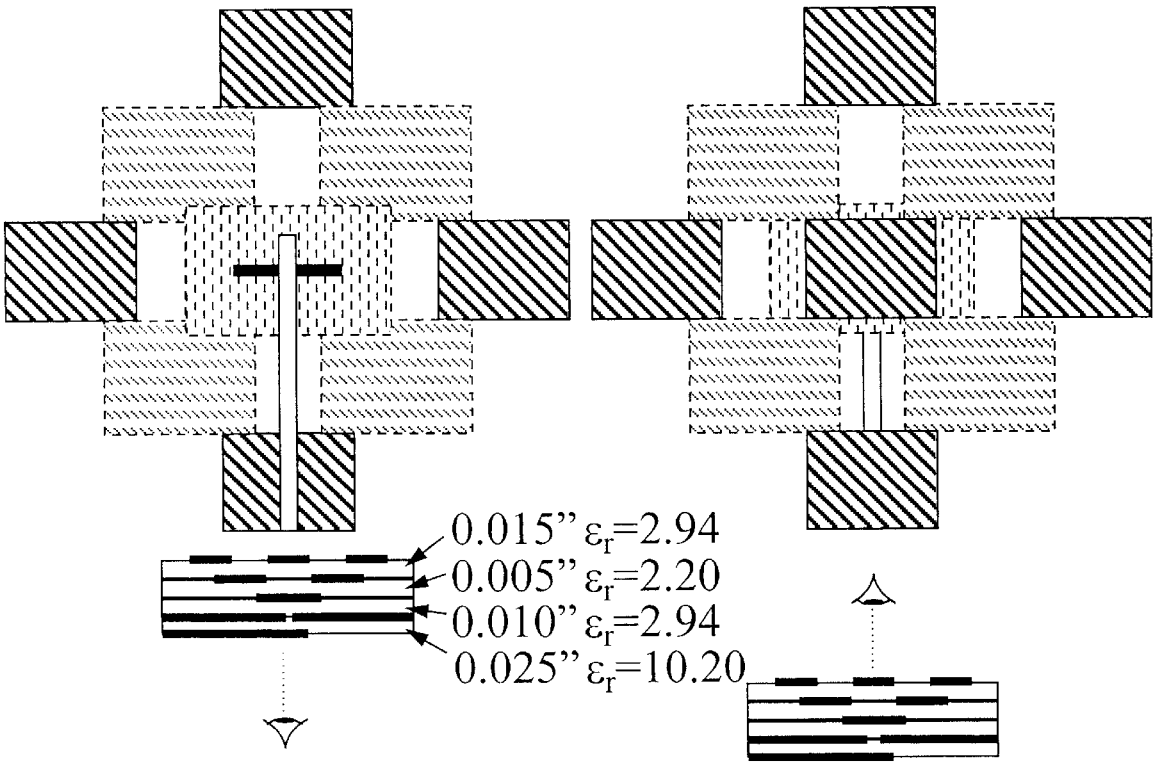
FIG. 7 is a diagram containing layer information relating to the antenna of FIG. 6.
Figure 8:
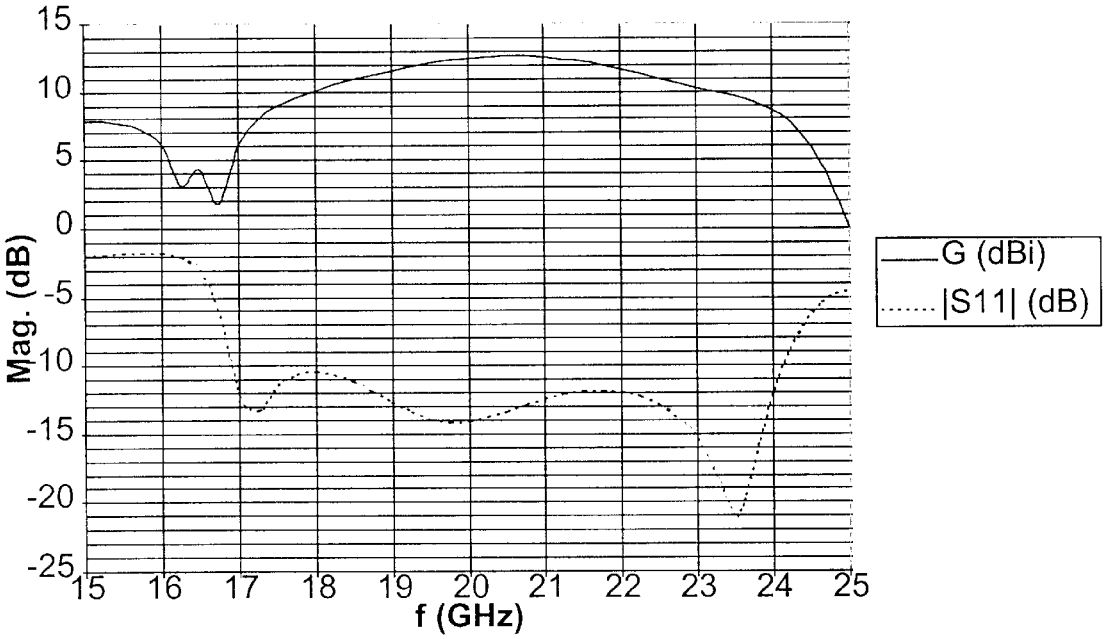
FIG. 8 is a frequency response graph for the antenna of FIGS. 6 and 7.
Figure 9:
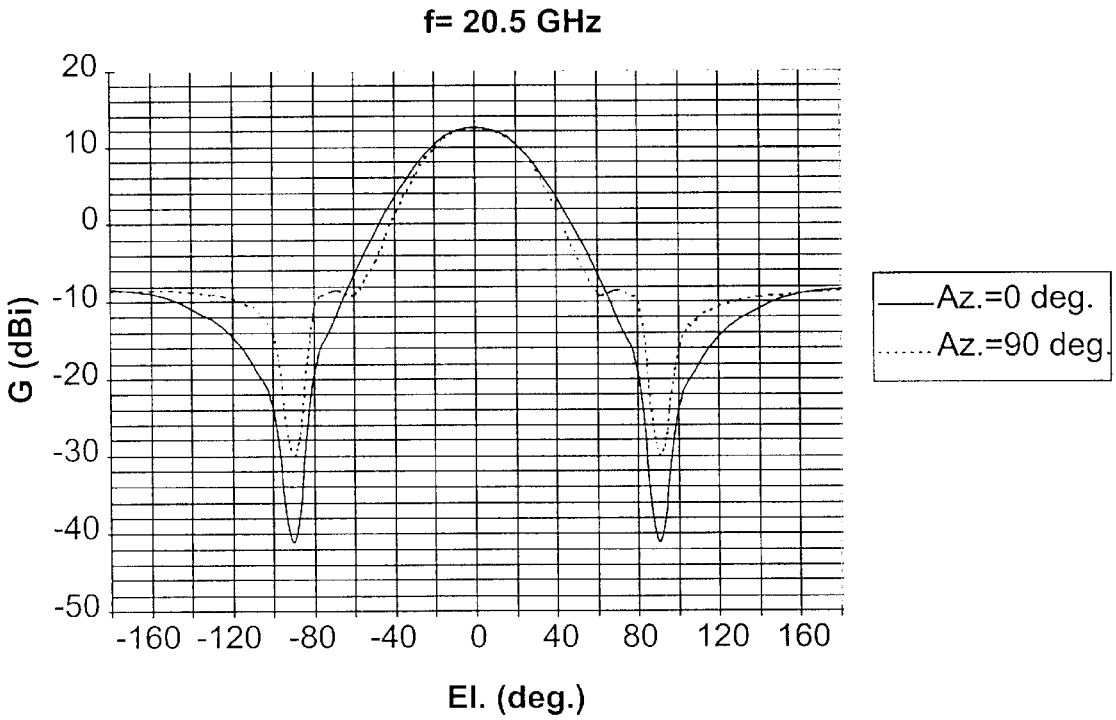
FIG. 9 is a graph of a far field radiation pattern generated by the antenna of FIGS. 6 and 7.

Referring to FIG. 6, an array antenna design using the V-configuration and having 5 patches on its outer layer is shown. Dimensions are shown for each patch. Referring to FIG. 7, layer related information relating to layer thickness and dielectric constant of layer materials is shown for the antenna of FIG. 6. Using these two figures, a V-configuration antenna according to the invention is easily implemented. As is evident from FIGS. 8 and 9, the antenna meets some design objectives.

Figure 10:
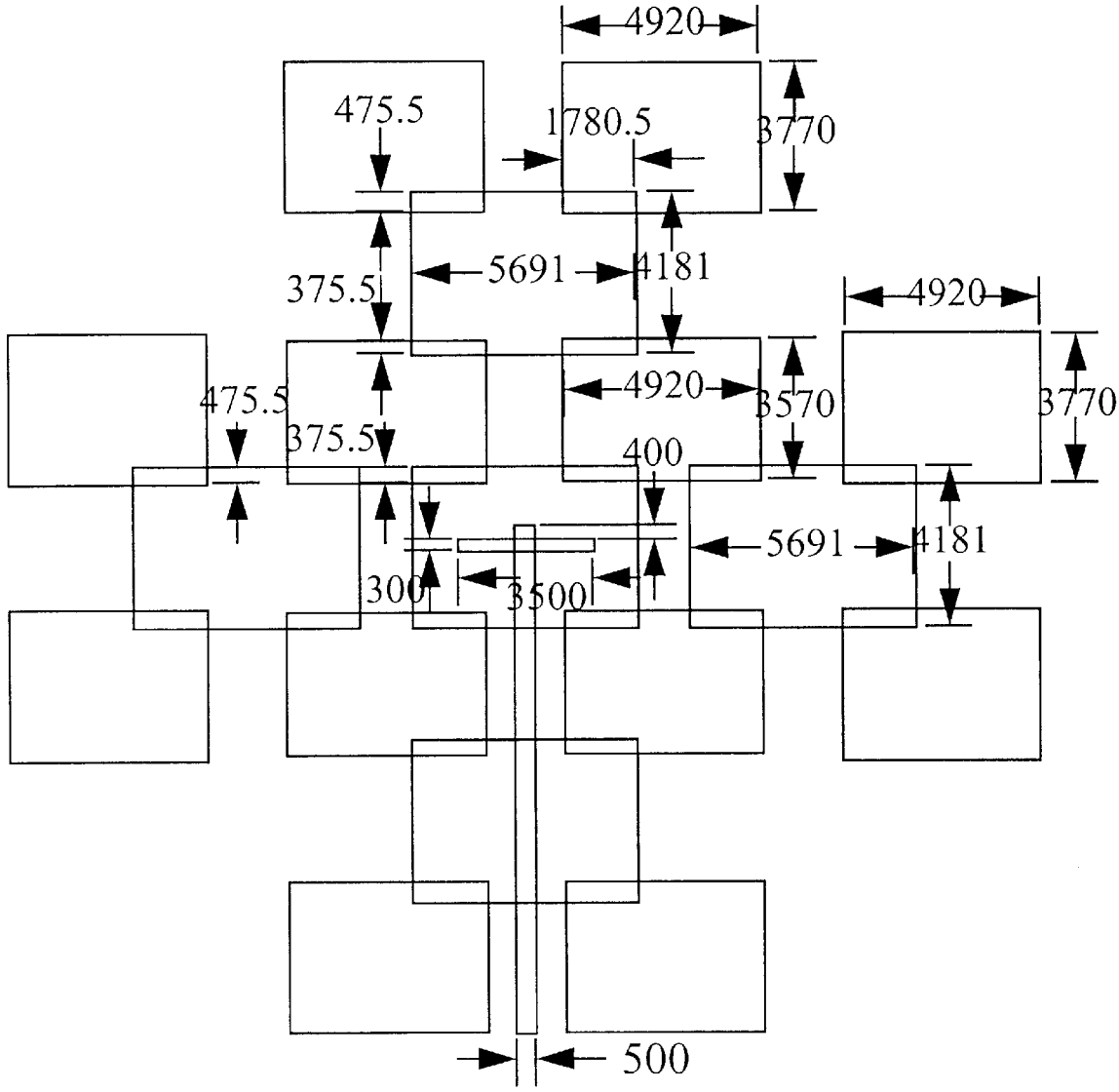
FIG. 10 is a simplified schematic view of a microstrip patch array antenna in a "VVV" configuration according to the invention comprising 12 patches on the outer most layer.
Figure 11:
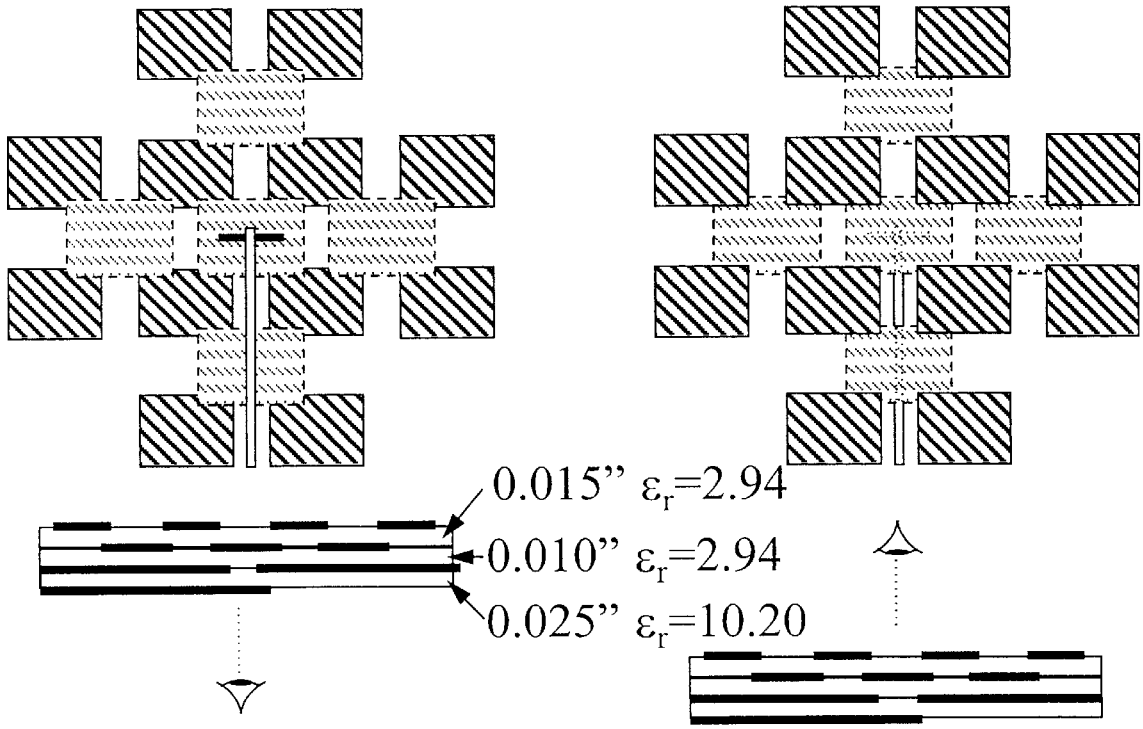
FIG. 11 is a diagram presenting layer related information for the microstrip patch array antenna of FIG. 10.
Figure 12:
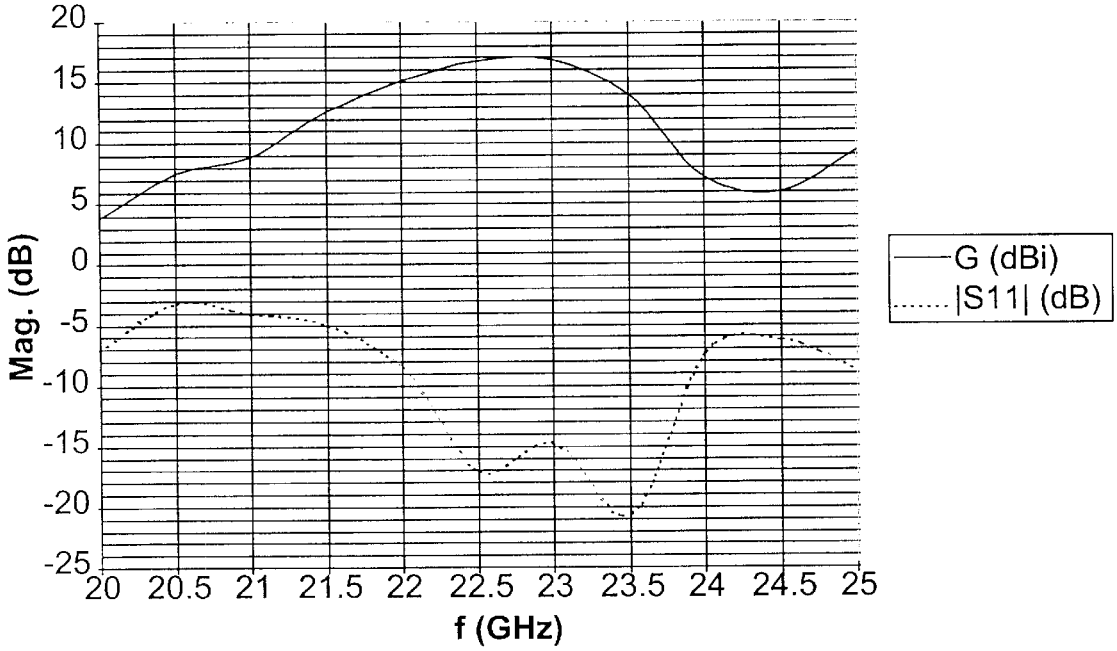
FIG. 12 is a frequency response graph for the antenna of FIG. 10.
Figure 13:
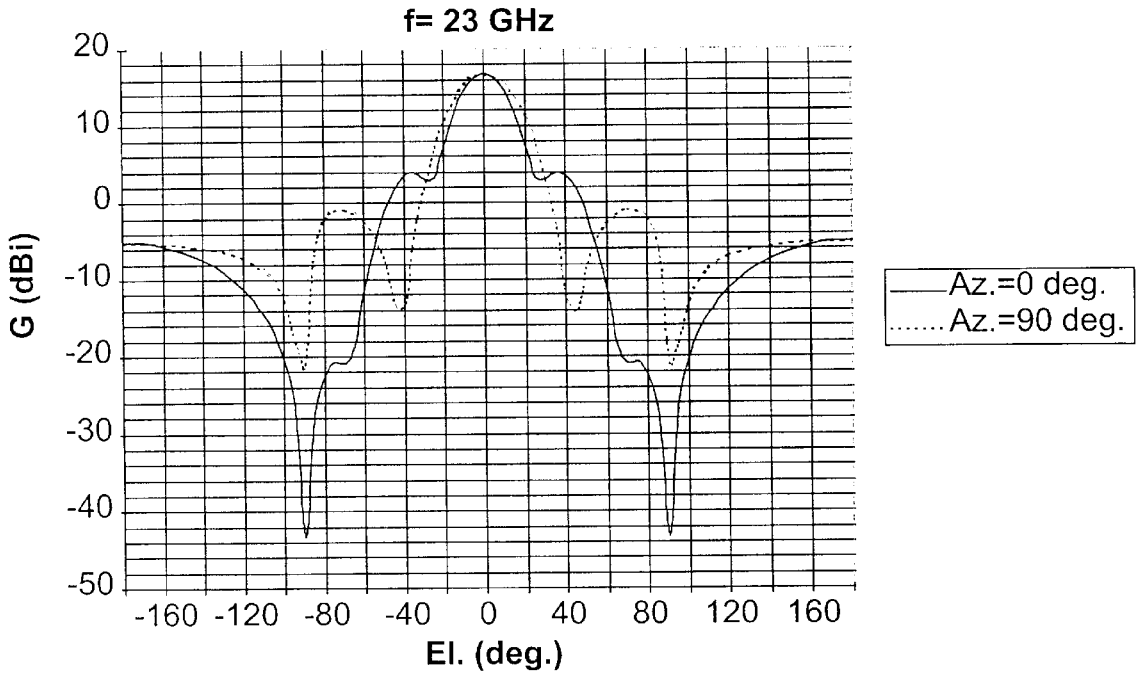
FIG. 13 is a graph of a far field radiation pattern generated by the antenna of FIG. 10.

Referring to FIG. 10, an array antenna design using the VVV-configuration and having 12 patches on its outer layer is shown. Dimensions are shown for each patch. Referring to FIG. 11, layer related information is shown for the antenna of FIG. 10. Using these two figures, a VVV-configuration antenna according to the invention is easily implemented. As is evident from FIGS. 12 and 13, the antenna meets reasonable design objectives.

To design a V-configuration antenna having 12 patches on its outer layer, phase is of concern. Different dielectric materials are used in the upper most dielectric layer in order to modify phase of the signals fed to patches on the top layer. This results in a high gain V-configuration antenna that substantially maintains phase across all radiating patches in the outer layer. Of course, to minimise discontinuities and facilitate phase shifting, it is preferable when constructing large arrays that different dielectrics are used throughout, for example on each layer, ensuring proper phase at substantially all of the patch radiators.

Important factors in design and implementation of antennas include gain and bandwidth. Generally, unless bandwidth requirements are not achievable, a VVV-configuration antenna array is preferred. Such an array is easily manufactured, low cost, offers a large aperture area, has high aperture efficiency, and allows for easy adjustment of aperture distribution during design. Of course, there are limitations to aperture size caused in part by coupling limitations. Preferably, an array comprises approximately 24 patch elements. Of course, arrays according to the invention can then, themselves, be assembled into an array to meet design requirements.

Of course, other factors such as desired radiation pattern including shape of the beam, sidelobe levels, backlobe level, and cross-polarisation levels also affect antenna design. As is evident from the results shown in the figures, designing for sidelobe levels below, for example, −15 dB is not difficult. Further, reduction of these and other undesired effects is possible, though often at the expense of aperture efficiency.

Figure 14:
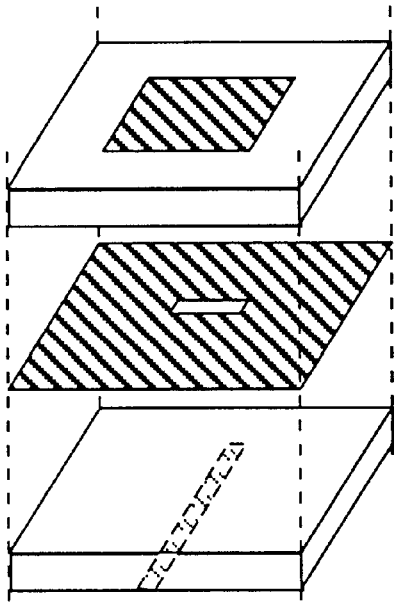
FIGS. 14, 15 and 16 are simplified diagrams of different feed structures for use with the invention.
Figure 15:
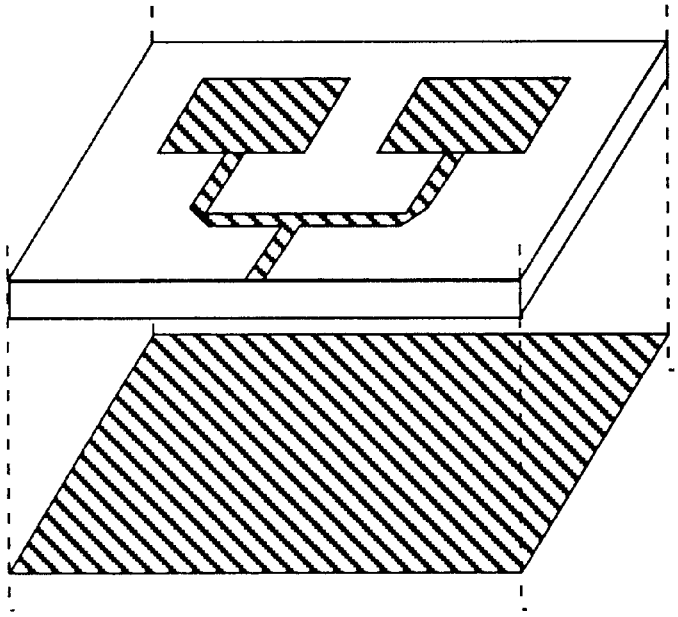
Figure 16:
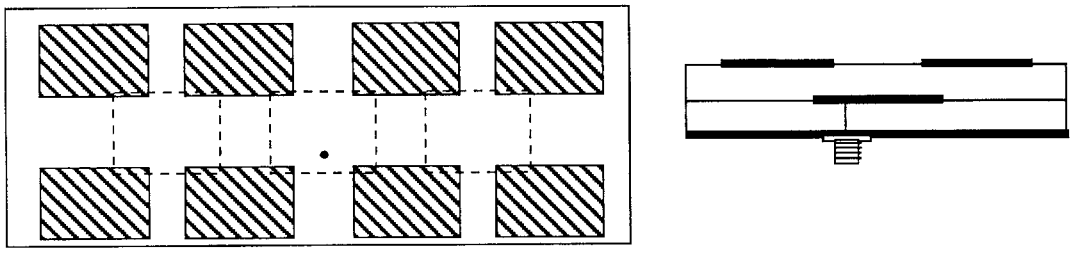

Preferably, slot coupling is used to feed the fed radiator. slot coupling ensures low cross-polarisation components in a radiated beam. Slots are easily manufactured and reduce a number of feedback coupling paths by isolating the feed network and devices from the radiating elements. Slot coupling of a microstrip patch is shown in FIG. 14. Alternatively, as shown in FIGS. 15 and 16, another feed is used in the form of a line feed or a probe feed. Feeding techniques for radiators are well known in the art. A suitable feed is selected dependent upon design requirements, manufacturing process, and radiator type.

Polarisation

Figure 17:
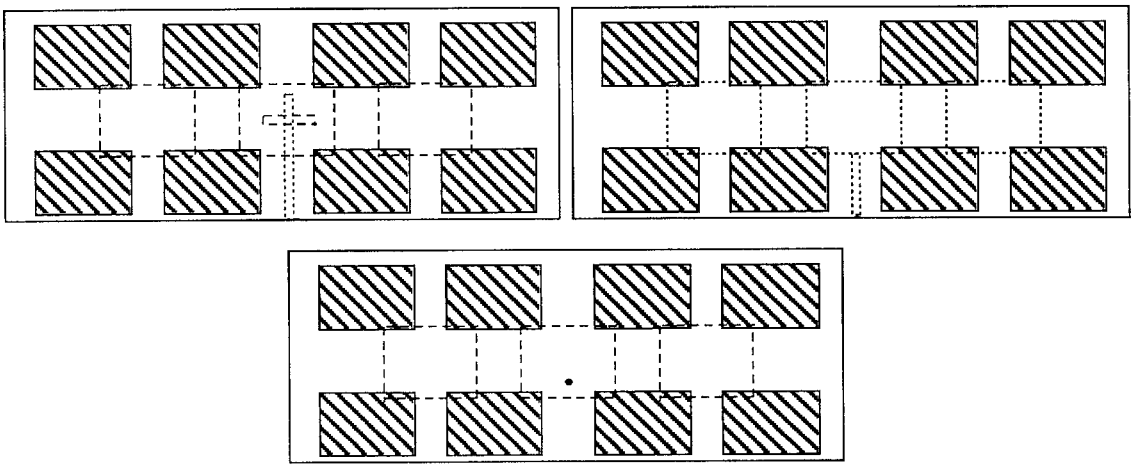
FIG. 17 is a simplified diagram of examples of feeds for linearly polarised microstrip patch array antennas according to the invention.

Because of the antenna structure, polarisation is effected through radiator placement and selection as well as through feed selection and placement. Referring to FIG. 17, examples of feeds for a linearly polarised microstrip patch array antenna according to the invention are shown.

Figure 18:
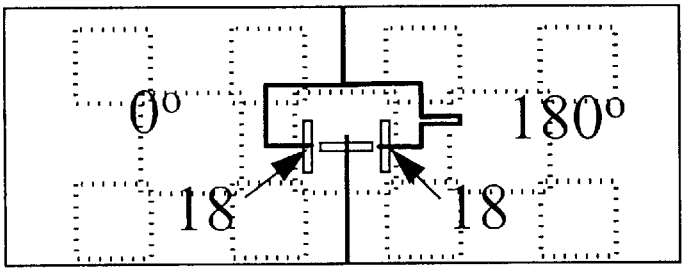
FIG. 18 is a diagram of a patch array wherein a fed patch is fed by three slots in order to improve isolation between polarised signals.

It is often desirable, as discussed above, to provide isolation between signals having different polarisations. Low cross-polarisation levels are generally a requirement of full duplex systems employing polarisation diversity. Currently, a very good solution, as shown in FIG. 18, comprises a three point feed on a single patch wherein the slots 18 are 180 degrees out of phase relative to each other. At a central location between the two slots 18, the signals from each slot combine so as to greatly reduce cross polarisation. There appears to be a limit of about 30 dB of isolation due to the proximity of the slots 18.

Figure 19A:
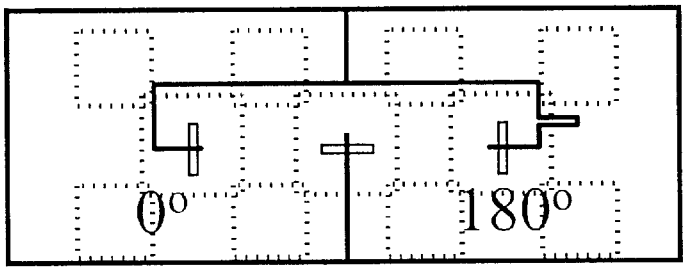
FIG. 19*a* is a diagram of a patch array wherein three different patches are each fed by a slot in order to improve isolation between polarised signals.
Figure 19B:
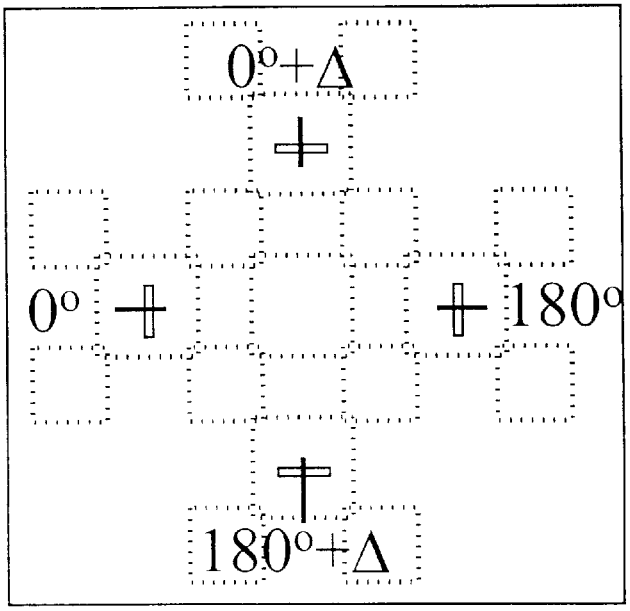
FIG. 19*b* is a diagram of a patch array wherein four different patches are each fed by a slot in order to improve isolation between polarised signals.
Figure 20:
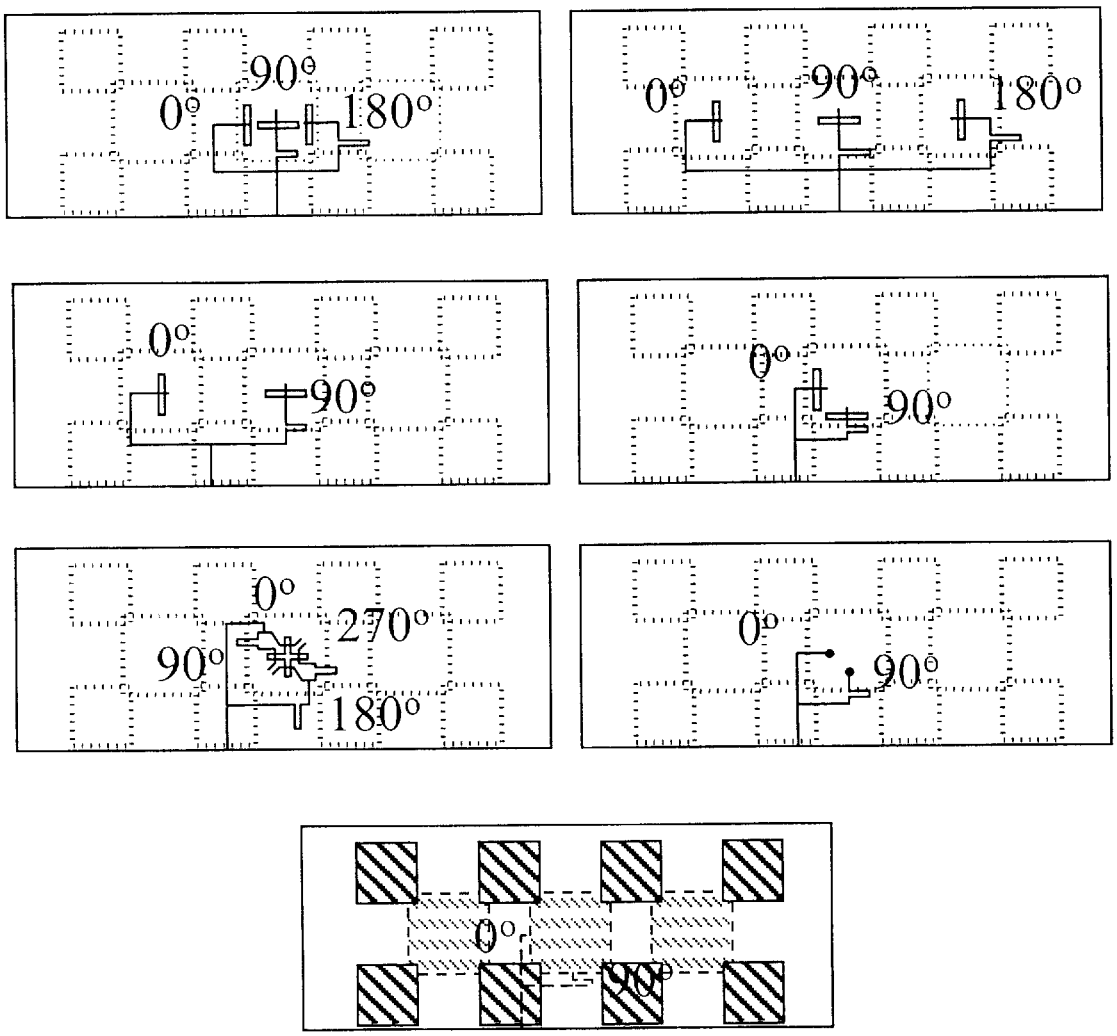
FIG. 20 is a diagram of a plurality of antenna arrays according to the invention achieving circular polarisation in an radiated beam.

Referring to FIG. 19, an embodiment of the invention wherein the slots 18 are each disposed to feed different patches. The slots are again approximately equidistant from the third slot feed and each of the slots 18 provides a feed signal 180 degrees out of phase relative to the other. This achieves much higher isolation—in the order of 40 dB—than a single patch with three feeds. Spacing of the slots 18 further, by adding radiators to the array structure, further enhances isolation. Phase adjustment of signals including phase shifting is well known in the art of antenna array design.

Multiple Beam Arrays

Figure 21:
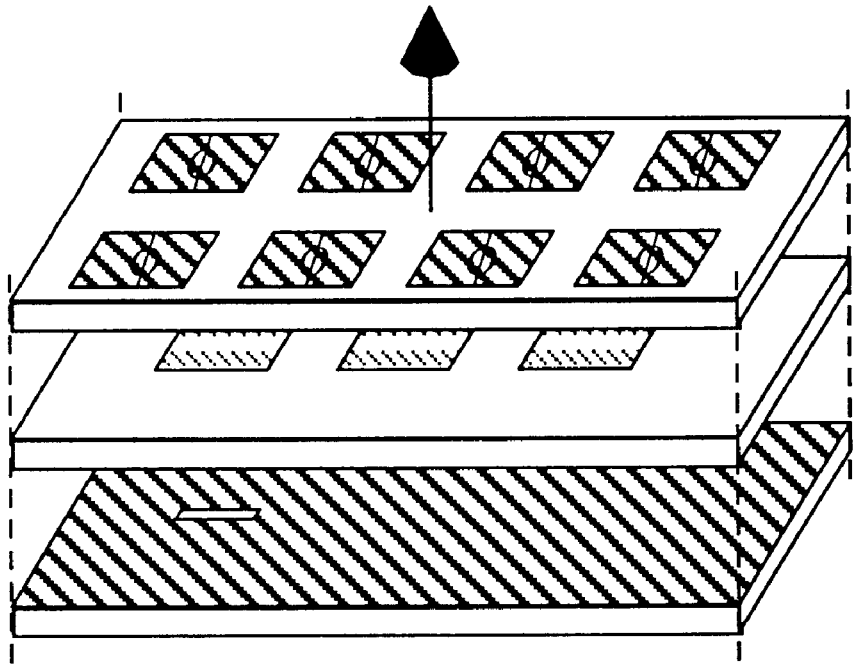
FIG. 21 is an exploded view of a broadside radiating series parasitically fed column array antenna wherein the patches have a phase relationship of an integer multiple of 360°.

Referring to FIG. 21, a broadside radiating series parasitically fed column array is shown. As shown, when a phase relationship between adjacent radiators is an integer multiple of 360 degrees, changing a position of the feed point does not substantially affect beam angle. Any of the patches on the lower layer of FIG. 21 when fed with a signal from a slot disposed therebelow results in a beam in the direction shown by the arrow.

Figure 22:
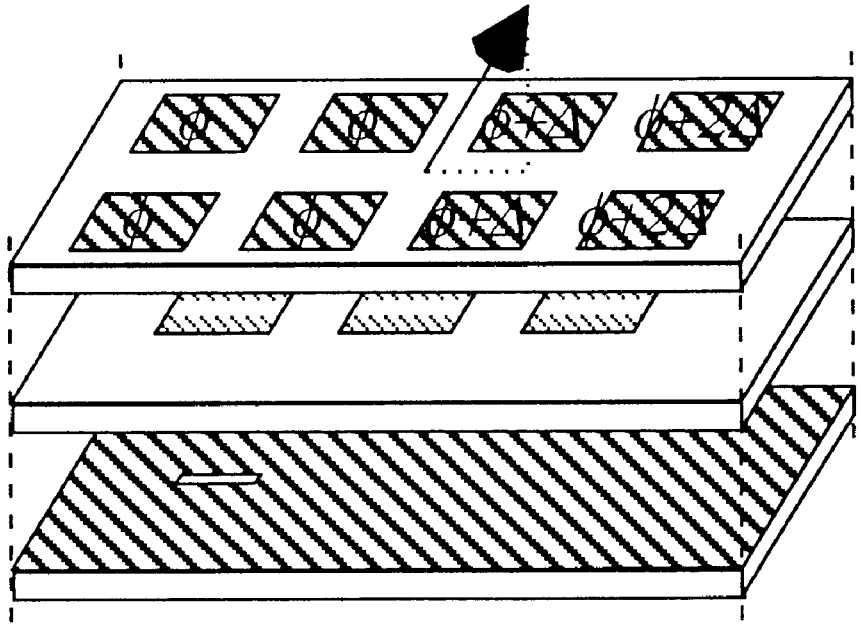
FIG. 22 is an exploded view of an offset beam series parasitically fed column array antenna wherein the patches have a phase relationship of other than an integer multiple of 360° resulting in beam squint.
Figure 23:
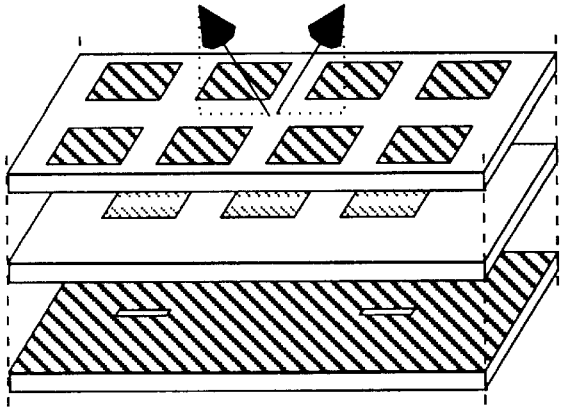
FIG. 23 is an exploded view of a multiple beam array antenna wherein the patches have a phase relationship of other than an integer multiple of 360°, resulting in beam squint and wherein a plurality of feeds each excite a beam having a different direction; and, FIG. 24 is an exploded view of a multiple beam array antenna wherein the patches have a phase relationship of other than an integer multiple of 360°, resulting in beam squint and wherein a plurality of feeds each excite a beam having a different direction and different polarisation.

In contrast, when a phase relationship of other than 360 degrees occurs, as shown in FIG. 22, beam squint results in a beam whose angle is dependent upon the feed location. As illustrated in FIG. 23, a multiple beam array is thereby easily formed using two different feed locations to produce beams in each of two different directions. Of course, such an implementation is band limited since phase relationships vary with changing frequencies. The two feeds are used simultaneously to provide energy to the structure for forming each of two beams in two directions. Alternatively, a plurality of feeds are used to direct the beam, one or more feeds provided with energy at a given instant in time while others are passive.

Figure 24:
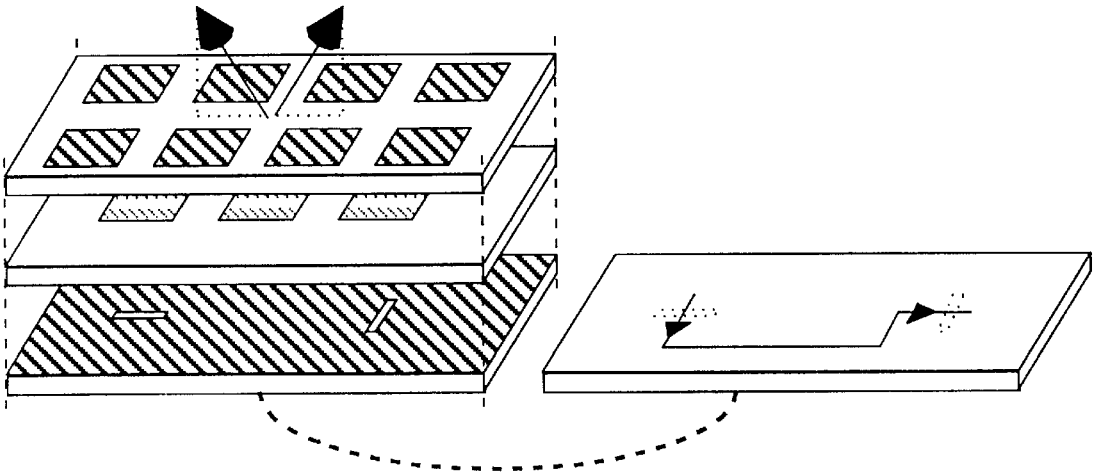

Referring to FIG. 24, a multiple beam array antenna is shown wherein each of the two beams has different polarisation characteristics. Such an array provides good isolation between two radiated signals, one provided by each feed. The isolation results from a combination of beam polarisation and beam direction.

The potential applications for medium to high gain planar arrays are numerous including RADAR systems, terrestrial wireless systems, and satellite communications systems.

Numerous other embodiments of the invention may be envisaged without departing from the spirit or scope of the invention.

What is claimed is:

1. An array antenna comprising:

a first radiator for coupling to a feed and for receiving energy from the feed and radiating the received energy;

a first array of radiators disposed so that each radiator within the first array of radiators is in close proximity to the first radiator and spaced therefrom for parasitically coupling to the first radiator; and, a second array of radiators disposed so that each radiator within the second array of radiators is in close proximity to a radiator in the first array of radiators and is spaced therefrom for parasitically coupling to said radiator from the first array of radiators and wherein some of the radiators in the second array of radiators is in close proximity to a plurality of radiators from the first array of radiators such that each of said some radiators is for being fed by at least two radiators from the first array of radiators.

2. An array antenna as defined in claim 1 wherein the radiators are printed radiators.

3. An array antenna as defined in claim 2 wherein a radiator from the first radiator, the first array of radiators, and the second array of radiators is a stacked patch radiator.

4. An array antenna as defined in claim 2 wherein the radiators are microstrip patches.

5. An array antenna as defined in claim 4 wherein the microstrip patches within the second array are fed by at least one of corners and edges of the microstrip patches in the first array.

6. An array antenna as defined in claim 4 wherein the radiators are arranged so as to maintain a same phase relationship between radiators.

7. An array antenna as defined in claim 4 wherein the radiators are sized so as to provide a predetermined bandwidth.

8. An array antenna as defined in claim 4 comprising a ground plane on which the antenna is disposed; and a feed for providing energy from an opposing side of the ground plane to the first radiator.

9. An array antenna as defined in claim 1 wherein the second array of radiators comprises the first radiator.

10. An array antenna as defined in claim 1 wherein the second array of radiators comprises a plurality of radiators disposed on a same layer of substrate material.

11. The antenna of claim 1 wherein the radiators are in a V-configuration having an increasing number of radiators disposed on each of a plurality of layers arranged approximately in the form of a V when viewed in cross-section, the cross-section taken through different layers, each layer for supporting an array of radiators, such that radiators in each array on a layer other than the outermost layers are for being fed by at least a radiator on an adjacent layer and for feeding radiators in an array of radiators on a different adjacent layer.

12. The antenna of claim 1 wherein the radiators are in a VVV-configuration wherein radiators in an array are disposed on a layer and are for being fed by at least a radiator on an adjacent layer and for feeding radiators in an array of radiators on a same adjacent layer.

13. An array antenna as defined in claim 1 comprising:

a second radiator spaced from the first radiator for coupling to a second feed.

14. An array antenna as defined in claim 13 wherein the first array of radiating elements and the second array of radiating elements are arranged with a spacing of other than $n\lambda/2$, wherein n is a positive integer, so as to provide a phase relationship between radiators when operated at a predetermined frequency, $\lambda$, other than a same phase relationship such that coupling energy to the first radiator results in a radiated energy field in a first direction and coupling energy to the second radiator results in a radiated energy field in a second other direction.

15. An array antenna as defined in claim 14 comprising a first feed for coupling energy to the first radiator the energy when coupled having a first polarisation direction and a second feed for coupling energy to the second radiator the energy when coupled having a second other polarisation.

16. An array antenna as defined in claim 13 wherein the first radiator and the second radiator are spaced apart, the array antenna comprising a feed disposed for coupling to the first radiator and for exciting a first mode of the first radiator;

a second feed disposed for coupling with the second radiator for exciting a second mode of the second radiator orthogonal to the first mode of the first radiator;

a third radiator spaced from the first radiator and the second radiator;

a third feed line for coupling to the third radiator and for exciting a mode of the third radiator orthogonal to the first mode and 180° out of phase with the second mode;

wherein during use each radiator within the first array of radiators and the second array of radiators is coupled to each of the first radiator, the second radiator and the third radiator, the coupling one of direct parasitic coupling and parasitic coupling through a radiator from the first array of radiators and the second array of radiators that is parasitically coupled to each of the first radiator, the second radiator and the third radiator.

17. An antenna as defined in claim 16 wherein the second and third radiators are approximately equidistant from the first radiator.

18. An antenna as defined in claim 17 wherein the second radiator and the third radiator are disposed symmetrically with respect to the first radiator.

19. An antenna as defined in claim 18 wherein the first radiator the second radiator and the third radiator are disposed along a straight line.

20. An antenna as defined in claim 16 comprising:

a fourth radiator spaced from the first radiator, the second radiator and the third radiator; and, a fourth feed line for coupling to the fourth radiator and for exciting a mode of the fourth radiator orthogonal to the second mode and 180° out of phase with the first mode.

21. The antenna of claim 16 wherein the first array of radiators and the second array of radiators are printed radiators disposed within at least two different layers.

22. The antenna of claim 16 wherein the radiators are in a VVV-configuration wherein radiators in an array are disposed on a layer and are for being fed by at least a radiator on an adjacent layer and for feeding radiators in an array of radiators on a same adjacent layer.

23. An array antenna comprising:

a ground plane;

a first substrate disposed on the ground plane;

a first radiator disposed on the first substrate, the first radiator for radiating energy;

a feed for providing energy to the first radiator;

a second substrate disposed on the first substrate and on the first radiator;

a first array of radiators disposed on the second substrate so that each radiator within the first array of radiators is in close proximity to the first radiator and spaced therefrom by the second substrate, each radiator within the first array of radiators for parasitically coupling to the first radiator; and, a second array of radiators disposed so that each radiator within the second array of radiators is in close proximity to a radiator in the first array of radiators and is spaced therefrom by a spacing substrate, each radiator within the second array of radiators for parasitically coupling to said radiator from the first array of radiators and wherein some of the radiators in the second array of radiators is in close proximity to a plurality of radiators from the first array of radiators such that each of said some radiators is for being fed by at least two radiators from the first array of radiators.

24. An antenna as defined in claim 23 wherein the spacing substrate is the second substrate.

25. An antenna as defined in claim 23 comprising a third substrate disposed on the second substrate and on the first array of radiators wherein the spacing substrate is the third substrate.

* * * * *

UNITED STATES PATENT AND TRADEMARK OFFICE

CERTIFICATE OF CORRECTION

PATENT NO. : 6,133,882
DATED : October 17, 2000
INVENTOR(S) : Lafleur et al.

It is certified that error appears in the above-identified patent and that said Letters Patent is hereby corrected as shown below:

On the title page, the name of the inventor: "LaFleur" should read --Lafleur--.

Col. 3, line 41: "an radiated beam" should read -- a radiated beam --.

Col. 4, line 29: "coupled form" should read -- coupled from --.

Col. 5, line 55: "horzontal" should read -- horizontal --.

Col. 6, line 64: "radiator. slot coupling" should read -- radiator. Slot coupling --.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*